US009487924B2

(12) United States Patent
Bertz et al.

(10) Patent No.: US 9,487,924 B2
(45) Date of Patent: Nov. 8, 2016

(54) TAMPER

(71) Applicant: JOSEPH VOEGELE AG, Ludwigshafen/Rhein (DE)

(72) Inventors: Klaus Bertz, Dittelsheim-Hessloch (DE); Ralf Weiser, Ladenburg (DE)

(73) Assignee: JOSEPH VOEGELE AG (DE)

( * ) Notice: Subject to any disclaimer, the term of this patent is extended or adjusted under 35 U.S.C. 154(b) by 4 days.

(21) Appl. No.: 14/590,311

(22) Filed: Jan. 6, 2015

(65) Prior Publication Data

US 2015/0225909 A1 Aug. 13, 2015

(30) Foreign Application Priority Data

Feb. 7, 2014 (EP) ..... 14154281

(51) Int. Cl.
*E01C 19/00* (2006.01)
*E01C 19/48* (2006.01)
*E01C 19/38* (2006.01)

(52) U.S. Cl.
CPC ..... *E01C 19/4853* (2013.01); *E01C 19/38* (2013.01)

(58) Field of Classification Search
CPC ..... E01C 19/38; E01C 19/4853
USPC ..... 404/118, 133.05, 133.1
See application file for complete search history.

(56) References Cited

U.S. PATENT DOCUMENTS 3,545,349 A * 12/1970 Henrich ..... E01C 19/4853 404/118
3,630,127 A * 12/1971 Yamato ..... E02D 3/068 404/133.1
4,493,585 A * 1/1985 Axer ..... E01C 19/407 404/102
4,507,014 A * 3/1985 Heims ..... E01C 19/40 173/101
4,828,428 A * 5/1989 Anderson ..... E01C 19/407 404/102
5,947,683 A * 9/1999 Kobayashi ..... F01D 5/145 415/191
6,019,544 A * 2/2000 Emerson ..... E01C 19/405 404/104

(Continued)

FOREIGN PATENT DOCUMENTS

EP 2325391 A1 5/2011
EP 2325392 A2 5/2011

(Continued)

OTHER PUBLICATIONS

European Search Report Dated Jul. 16, 2014, Application No. EP 14154281.1-1604, Applicant Joseph Vöegele AG, 5 Pages.

(Continued)

*Primary Examiner* — Raymond W Addie
(74) *Attorney, Agent, or Firm* — Brooks Kushman P.C.

(57) ABSTRACT

A tamper of a screed includes a tamper bar secured to a connecting rod in which an eccentric bushing is rotatable. The eccentric bushing is adapted to be rotationally displaced on an eccentric section of a drive shaft relative to the eccentric section and to be rotationally coupled with the eccentric section at relative rotational positions defining different stroke lengths of the tamper bar. A changeover between the rotational positions is accomplishable by a reversal of the direction of rotation of the drive shaft. The eccentric bushing is adapted to be locked at each respective rotational position by means of a locking and/or coupling device against inadvertent displacement from the respective rotational position. The locking and/or coupling device is adapted to be released and/or engaged automatically or by remote control for effecting a changeover from one rotational position to the next.

20 Claims, 8 Drawing Sheets

(56) References Cited

U.S. PATENT DOCUMENTS

| | | | | |
|---|---|---|---|---|
| 6,124,580 | A * | 9/2000 | Nottmeier | E01C 19/407 219/618 |
| 6,457,902 | B1 | 10/2002 | Artzberger et al. | |
| 6,551,018 | B2 * | 4/2003 | Baker | E01C 19/407 404/102 |
| 8,371,770 | B1 * | 2/2013 | Rasmusson | 404/102 |
| 8,534,955 | B2 | 9/2013 | Buschmann et al. | |
| 8,998,530 | B2 | 4/2015 | Buschmann et al. | |
| 2011/0123270 | A1 * | 5/2011 | Buschmann | E01C 19/407 404/133.05 |

FOREIGN PATENT DOCUMENTS

| | | | |
|---|---|---|---|
| JP | S5740006 | A | 3/1982 |
| JP | S5771536 | U | 5/1982 |
| JP | 2011106261 | A | 6/2011 |
| JP | 2011106263 | A | 6/2011 |

OTHER PUBLICATIONS

Japanese Office Action Dated Jan. 19, 2016, Application No. 2014-218035, 2 Pages.

* cited by examiner

TAMPER

CROSS-REFERENCE TO RELATED APPLICATIONS

This application claims foreign priority benefits under 35 U.S.C. §119(a)-(d) to European patent application number EP 14154281.1, filed Feb. 7, 2014, which is incorporated by reference in its entirety.

TECHNICAL FIELD

The disclosure relates to a tamper for a screed.

BACKGROUND

The stroke length of the tamper bar of a tamper in a screed must be changed, e.g., depending on the laying thickness or other laying parameters. Normally, this is carried out such that, during a shutdown, the eccentric drive mechanism of the tamper bar is exposed and the eccentric bushing, which is fixed in position on the eccentric section, is released by means of tools, manually rotated relative to the eccentric section and fixed in position once more. This has the effect that the sum of the eccentricities of the eccentric section and of the eccentric bushing, which are effective in the direction of stroke of the tamper bar, change and, consequently, the stroke length changes as well. This procedure is cumbersome and time-consuming, since a screed has normally arranged therein a plurality of tampers, e.g., in an extending screed at least four tamper bars and eight connecting rods.

EP 2 325 392 discloses a tamper in the case of which the stroke length of the tamper bar is infinitely variable in a remotely controlled manner via a gear mechanism during laying without any change in the direction of rotation of the drive shaft, the gear mechanism engaging between the eccentric bushing and the eccentric section. A manual adjustment of the stroke length of the tamper bar is thus no longer necessary.

The tamper according to EP 2 325 391 B1, which represents a tamper of the type in question, allows a change in the stroke length of the tamper bar without any tools being necessary, said change being accomplished by a reversal of the direction of rotation of the drive shaft. The eccentric bushing and the eccentric section have provided between them a driver and a curved track with end stops for the driver, the stops being, when seen in the direction of rotation, spaced apart at a distance that is larger than the circumferential length of the driver. When the reversal of the direction of rotation takes place, the eccentric bushing is rotationally displaced relative to the rotating eccentric section e.g., due to the moment of inertia of the eccentric bushing and due to the reaction forces resulting from the compacting effect of the tamper bar, until the driver, after having been moved away from one of the end stops, moves into contact with the other end stop. The two end stops define different relative rotational positions between the eccentric bushing and the eccentric section, at which different stroke lengths of the tamper bar result from the different sums of the eccentricities of the eccentric section and of the eccentric bushing in the direction of stroke of the tamper bar, e.g., 4.0 mm at one of the relative rotational positions and 8.0 mm at the other relative rotational position. Although the tamper can be changed over without any tools, it is characterized by a simple structural design in comparison with the driving devices provided between the eccentric bushing and eccentric section in the tamper according to EP 2 325 392 A.

In particular embodiments operating with low mass and/or friction and/or compacting forces, do not allow the changeover principle to be used with sufficient operational reliability.

SUMMARY

It is an object of the present disclosure to improve a tamper of the type mentioned at the beginning such that, though the stroke length of the tamper bar can be changed by a reversal of the direction of rotation without making use of any tools, it will no longer change inadvertently. The operational reliability is to be enhanced also for tampers which are adapted to be changed over by a reversal of the direction of rotation and which operate with low mass and/or friction and/or compacting forces.

In addition, the total disclosure of EP 2 325 391 A is herewith incorporated by reference, and as regards features that are not explained in detail in the description following herein below, EP 2 325 391 A1 is referred to.

According to the present disclosure, a changeover from a relative rotational position of the eccentric bushing on the eccentric section to another relative rotational position is effected by a reversal of the direction of rotation of the drive shaft. Since the eccentric bushing is, in addition, locked relative to the eccentric section at the respective adjusted relative rotational position via the locking device, an inadvertent change of the stroke length of the tamper bar is no longer possible, not even in critical operating situations, as long as no reversal of the direction of rotation is initiated. The locking effect or locking force of the locking device is chosen such that forces or moments acting on the eccentric bushing in disadvantageous operating situations will not be able to overcome the locking device, said locking device being only released in the case of an intentional changeover through a reversal of the direction of rotation of the drive shaft.

According to an advantageous embodiment, the eccentric bushing and the eccentric section have provided between them two end stops in a curved track and a driver, which are adapted to be rotated relative to one another about a rotation center when the changeover takes place, the respective position of contact of the driver on the end stops defining two relative rotational positions of the eccentric bushing. The locking and/or coupling device locks here the eccentric bushing at least at these two relative rotational positions against movements resulting from parasitic torques that may cause an inadvertent change in the relative rotational position. This concept offers the advantage that, when the tamper is in operation, also high torques are transmitted in a form-fit and therefore reliable manner in the adjusted direction of rotation of the drive shaft without applying any load to the locking and/or coupling device. The concept of the present disclosure is, however, not limited to the combination of the driver, the end stops and the locking and/or coupling device, but even the device itself may partly be used as a driver/end stop. Furthermore, the concept of the present disclosure is not limited to two relative rotational positions, but, making e.g., use of the locking and/or coupling device, a larger number of relative rotational positions may selectively be adjusted by a respective reversal of the direction of rotation of the drive shaft.

According to an advantageous embodiment, the locking and/or coupling device is adapted to be released or overcome through forces produced when the changeover takes place, said forces resulting from the angular acceleration and/or the angular speed and/or the moment of inertia and/or a remotely controlled deceleration of the eccentric bushing. The release of the locking and/or coupling device may, in an expedient manner, even take place only within or outside a predetermined time window.

Another advantageous embodiment is so conceived that, when the changeover takes place, an additional changeover torque in the direction of the respective relative rotational position can even be produced on the eccentric bushing by means of the locking and/or coupling device, preferably by means of the force of a spring. In this respect, a dead center passing spring mechanism may be used. A changeover impulse, with which the eccentric bushing releases the adjusted relative rotational position and starts moving in the direction of a different rotational position, originates from the reversal of the direction of rotation, e.g., from the moment of inertia of the eccentric bushing. The additional changeover torque, in addition to the changeover impulse generated by the reversal of the direction of rotation, can eventually move the eccentric bushing reliably to the new relative rotational position. Furthermore, the changeover torque produces the respective locking force.

According to an advantageous embodiment, a, preferably limited, locking force is produced through the force of a spring and/or through rotational friction and/or magnetically and/or hydraulically and/or pneumatically by means of the locking and/or coupling device. The locking force may just be limited such that, under disadvantageous operating conditions, parasitic changeover moments occurring at the eccentric bushing will not be able to cause an inadvertent change of the stroke length of the tamper bar.

According to another advantageous embodiment, the eccentric section has arranged thereon a pivotable spring support, preferably a telescope that is spring-loaded in the direction of extension or a flexible spring which is supported in an abutment of the eccentric bushing under a preload and which, when the changeover takes place, is adapted to be reduced in length against the preload from spring support positions defining the relative rotational positions up to a dead center and to be extended under said preload when the dead center has been exceeded. The spring support thus produces, when the dead center has been exceeded, the additional changeover torque with which the eccentric bushing is reliably advanced to the selected new relative rotational position and then retained at this position.

According to an advantageous embodiment, the locking and/or coupling device is configured as a detent device, which is adapted to be acted upon by a force and which comprises at least one detent element and detent recesses. The locking effect results here e.g., from a combination of a form-fit and a force-fit connection.

According to another advantageous embodiment, a, preferably radial, spring-loaded detent element is supported in the eccentric bushing, and the eccentric section, e.g., the driver, has provided thereon detent recesses for the detent element, said detent recesses being positioned such that they correspond to the relative rotational positions. At the relative rotational position reached after a changeover, the detent element engages one of the detent recesses thus preventing an inadvertent turn-back of the eccentric bushing in a reliable manner.

According to another embodiment, a first spring, which acts on the detent element, is supported in the eccentric bushing on a centrifugal mass body which is radially movable in a fluid chamber and which is supported in the eccentric bushing via a second spring acting opposite to said first spring. Preferably, a fluid throttle gap is provided between the centrifugal mass body and a motion guide for the centrifugal mass body, said fluid throttle gap damping a displacement of the centrifugal mass body under centrifugal forces and creating thus a time window within and/or outside of which a changeover can or has to be carried out exclusively. Preferably, the detent element and the detent recesses may, in this case, even cooperate in a purely form-fit manner, since the centrifugal mass body is capable of lifting the detent element fully out of the detent recess. In this embodiment, it is imaginable to optionally assign the functions of the driver and of the end stops to the detent element and the detent recesses simultaneously, said driver and end stops being thus no longer necessary.

According to another advantageous embodiment, a detent element is attached to a centrifugal mass body acted upon by a spring in the release direction of the locking and/or coupling device, in this case towards the rotation center. The detent element engages a curved track, e.g., in the driver, which is fixedly provided on the eccentric section and which comprises a changeover section and at both ends thereof, at end stops, approximately radial detent recesses for the detent element, said detent recesses being oriented in the locking direction. Also in this case, the detent element and the detent recesses may fulfil the function of the driver and of the end stops, although a combination is possible as well. In this embodiment, the spring-loaded locking element arrives at the engagement position in a detent recess, when the eccentric bushing has reached the relative rotational position and rotates at an angular speed, which caused the centrifugal mass body to move away from the rotation center. The changeover is initiated by the reversal of the direction of rotation of the drive shaft. The detent element and the detent recesses fulfil here the functions of the driver and of the end stops, which are therefore no longer necessary.

According to an alternative embodiment, a detent element is attached to a centrifugal mass body acted upon by a spring in the locking direction of the locking and/or coupling device away from the rotation center. The detent element engages a curved track, e.g., in the driver, which is fixedly provided on the eccentric section and which comprises a changeover section and at both ends thereof, at end stops, approximately radial detent recesses, which are oriented in the release direction here towards the rotation center. Also in this case, the detent element and the detent recesses fulfil the function of the driver and of the end stops. In this embodiment, a changeover is only possible above a limit speed of the eccentric bushing and as soon as the centrifugal mass body lifts the detent element out of the detent recess.

The operational reliability with respect to changeovers for the purpose of changing the stroke length of the tamper bar is increased still further according to an embodiment in which the eccentric bushing, preferably a centrifugal mass body movable therein against the force of a spring, and the connecting rod have provided thereon a, preferably spring-loaded, friction element and a friction surface for the friction element. The spring-loaded condition of the friction element allows a braking torque for the eccentric bushing to be adjusted. The friction surface may here extend only between the two detent recesses without including said detent recesses that define the desired relative rotational positions. The cooperation between the friction element and the friction surface supports the changeover, e.g., in the case of embodiments of eccentric bushings having a low moment of inertia or embodiments of tamper sections with a low angular acceleration. The friction moment used for supporting the changeover and produced by the cooperation between the friction element and the friction surface is only effective outside of the relative rotational positions. The locking function is established at the respective relative rotational position and at an adequate angular speed of the eccentric bushing, e.g., at an adequately low or high angular speed at which the centrifugal mass body is displaced inwards due to the spring acting thereon or outwards through centrifugal forces.

According to an alternative embodiment, the locking and/or coupling device is configured as a friction-type coupling generating a predetermined locking force and provided between the eccentric bushing and the eccentric section. This embodiment deviates from the conventional principle of an eccentric bushing that can easily be rotationally displaced on the eccentric section, insofar as these two components are here secured to one another by the friction-type coupling with a predetermined locking force. The eccentric bushing is connected to a brake body, preferably a brake disk. At least one friction element, preferably a brake pad or a brake calliper, which is stationarily supported relative to the eccentric bushing, cooperates with the brake body when the changeover takes place, said friction element being adapted to be operated by remote control on the brake body between a release position and braking positions. The locking force of the friction-type coupling is adjusted to a value that is high enough for preventing moments, which occur at the eccentric bushing in critical operating situations and which try to rotationally displace the same relative to the eccentric section, from overcoming the locking force. Due to the intentional deceleration, e.g., during or in combination with a reversal of the direction of rotation of the drive shaft, the locking force of the friction-type coupling is overcome so as to effect a changeover of the eccentric bushing between relative rotational positions. The friction-type coupling makes it possible to dispense with the driver and the end stops, but it may also be advantageous to provide said friction-type coupling in combination with the driver and the end stops of a curved track. The braking force can be generated mechanically, e.g., by means of a Bowden cable, hydraulically, electrically or pneumatically, without any necessity of making use of tools for changing the stroke length.

Since the friction-type coupling is able to permanently produce a predetermined, comparatively high locking force, which can be overcome by an intentional, remotely controlled deceleration of the eccentric bushing, it is even possible to adjust an arbitrary number of relative rotational positions and to reliably maintain each of them when the tamper is in operation. In this respect it may be of advantage when more than two different relative rotational positions of the eccentric bushing are adjustable via the brake body, and when the predetermined, preferably adjustable, locking force in the friction-type coupling results at each of the selected relative rotational positions in a holding torque that results from the locking force and that is higher than undesired parasitic torques occurring on the eccentric bushing as a result of the operation of the tamper.

Embodiments of the subject matter of the present disclosure are explained making reference to the drawings, in which:

Below, an advantageous embodiment of the disclosure will be illustrated in more detail with reference to the below described drawings.

DETAILED DESCRIPTION

As required, detailed embodiments of the present disclosure are disclosed herein; however, it is to be understood that the disclosed embodiments are merely exemplary of the disclosure that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 2:
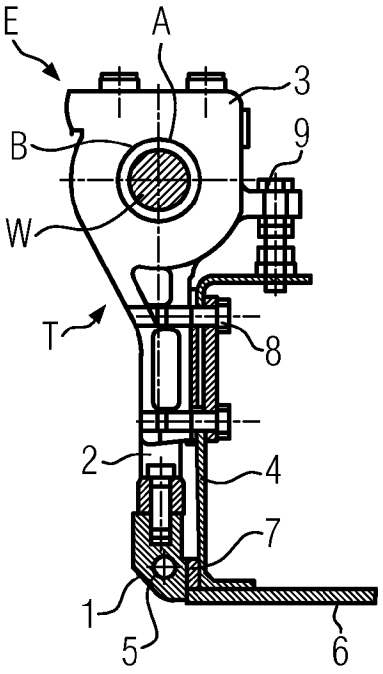
FIG. 2 shows a section in plane II-II in FIG. 1 at an enlarged scale in comparison with FIG. 1.
Figure 1:
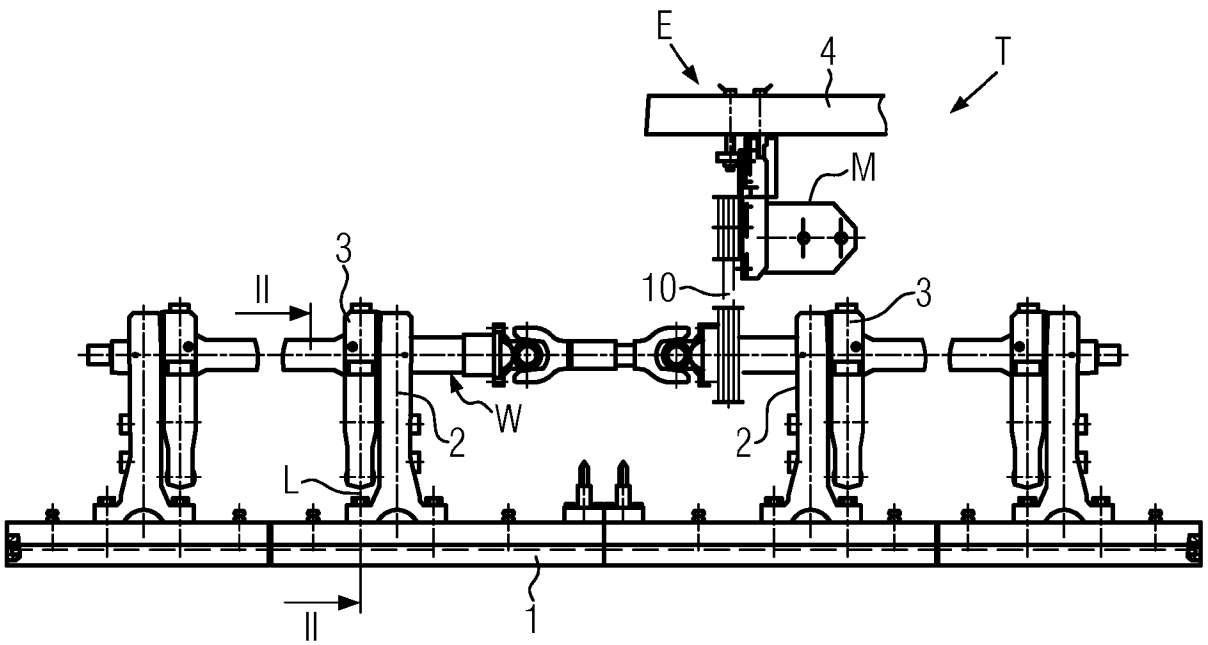
FIG. 1 shows a view of a tamper of a screed.

FIGS. 1 and 2 schematically show a tamper T of a screed E of a road finishing machine. The tamper T serves to pre-compact laying material during the laying of a pavement of bituminous or concrete laying material with a selectable pavement thickness.

The tamper T comprises at least one tamper bar 1 cyclically acting on the laying material with essentially vertical strokes and a selectable stroke length. The respective tamper bar 1 is mounted on two connecting rods 2 which generate strokes through the rotation of a rotatingly driven drive shaft W and transmit them to the tamper bar 1. The drive shaft W is stationarily supported at a frame 4 of the screed E in bearing supports 3 which are fixed with mounting screws 8 and whose vertical height can be adjusted with adjusting screws 9, so as to align, for example, the bottom dead center of the stroke length of the tamper bar 1 with a screed plate 6 mounted at the bottom side of the frame 4.

The eccentric shaft W comprises an eccentric section A in the area of the respective connecting rod 2 on which an eccentric bushing B is arranged and rotatably supported in the eye of the connecting rod 2. The drive shaft W is driven via a drive motor M (hydraulic or electric motor) whose direction of rotation can be reversed and a belt or chain drive 10. As an alternative, a drive motor M running in the direction of rotation may be provided, which selectively drives the drive shaft W in the one or the other direction of rotation via a change gear (not shown) effecting the reversal of the direction of rotation.

FIG. 2 shows through dot-dash lines the eccentricity of the eccentric section A of the drive shaft W. The eccentric bushing B has a cylindrical internal bore arranged on the cylindrical outer circumference of the eccentric section A and having a cylindrical outer circumference which is eccentric thereto and adapted to be rotated in the eye of the connecting rod 2. The magnitude of the stroke length results from the sum of the eccentricities of the eccentric section A and of the eccentric bushing B in the direction of the stroke length of the tamper bar 1. By varying the relative rotational position between the eccentric bushing B and the eccentric section A, the sum of the eccentricities increases or decreases and the stroke length of the tamper bar 1 changes accordingly. A changeover between different relative rotational positions of the eccentric bushing B of the tamper T is executed by a reversal of the direction of rotation of the drive shaft W without making use of a tool.

Figure 3:
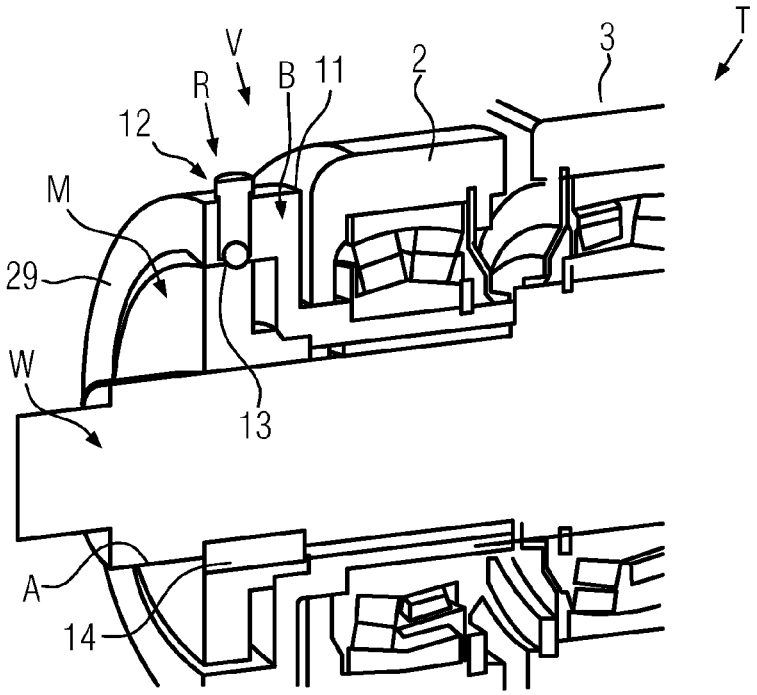
FIG. 3 shows a perspective fragmentary sectional view of an embodiment of a tamper.
Figure 4:
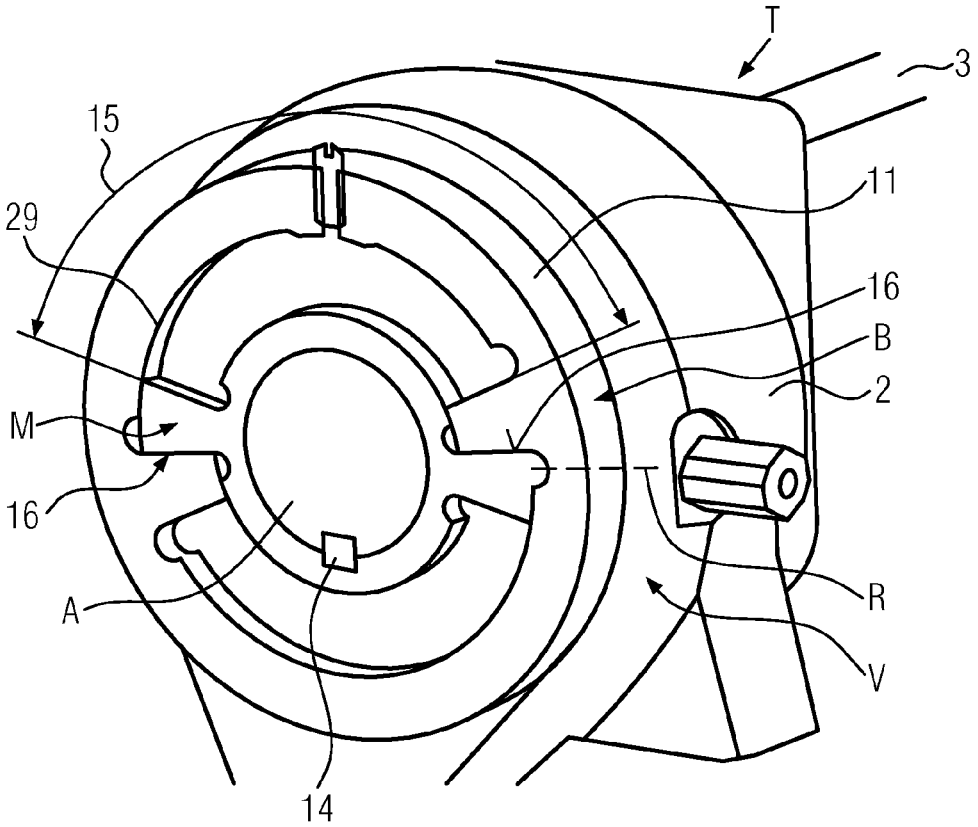
FIG. 4 shows another perspective view of the embodiment according to FIG. 3.

In the embodiment of the tamper T according to FIGS. 3 and 4, the eccentric section A and the eccentric bushing B have provided between them a driver M, which is here provided on the eccentric section A, and a curved track 29 with two end stops 16 for the driver M. The two end stops 16 are spaced apart in the circumferential direction at a distance exceeding the circumferential length of the driver M and define here two different relative rotational positions between the eccentric bushing B and the eccentric section A, between which a changeover can be effected by a reversal of the direction of rotation of the drive shaft W, without making use of a tool.

In the embodiment according to FIGS. 3 and 4, the eccentric bushing B is supported, e.g., by means of a friction bearing, on the eccentric section A of the drive shaft W. The connecting rod 2 is supported via a bearing arrangement on the eccentric bushing B. The rotational resistance of the eccentric bushing B on the eccentric section A is low, so is the rotational resistance of the eccentric bushing B in the connecting rod 2. The eccentric bushing B has, e.g., as an option, an axial end flange 11 outside of the connecting rod 2, said axial end flange 11 extending from outside beyond the driver M, which is rotationally fixed on the eccentric section A by means of a key 14.

In addition to the coupling, which is defined between the eccentric bushing B and the eccentric section A due to the fact that the driver M abuts on the respective end stop 16 and which is effective in only one direction of rotation, a locking and/or coupling device V is provided according to the present disclosure, said locking and/or coupling device V being used for locking the eccentric bushing B at the respective adjusted relative rotational position with respect to the eccentric section A against rotational movements in a direction opposite to the direction of rotation of the drive shaft W selected at the time in question.

According to FIG. 4, the end flange 11 has formed therein along part of its circumference the curved track 29, which defines the end stops 16 for the driver M. Furthermore, a, preferably approximately radial, detent element R is secured in position in the axial end flange 11, said detent element R comprising e.g., a spring-loaded ball 12, which, at the respective relative rotational position of the eccentric bushing B relative to the eccentric section A defined when the driver M abuts on an end stop 16, engages a detent recess 13 formed in the driver M and produces a locking force that prevents the driver M and/or the eccentric bushing B from leaving the relative rotational position adjusted. The changeover area is indicated by reference numeral 15.

The locking force produced by the cooperation between the detent element R and the detent recess 13 is selected such that it cannot be overcome by parasitic displacement moments created e.g., on the eccentric bushing B in unfavorable operating situations of the tamper T, but will only be overcome e.g., by the moment of inertia of the eccentric bushing B that becomes effective when a reversal of the direction of rotation of the drive shaft W takes place. The then occurring moment of inertia is additionally supported by the rotational resistance of the eccentric bushing B in the connecting rod 2 on the larger bearing diameter in comparison with the smaller bearing diameter of the eccentric bushing B on the eccentric section A.

Figure 5:
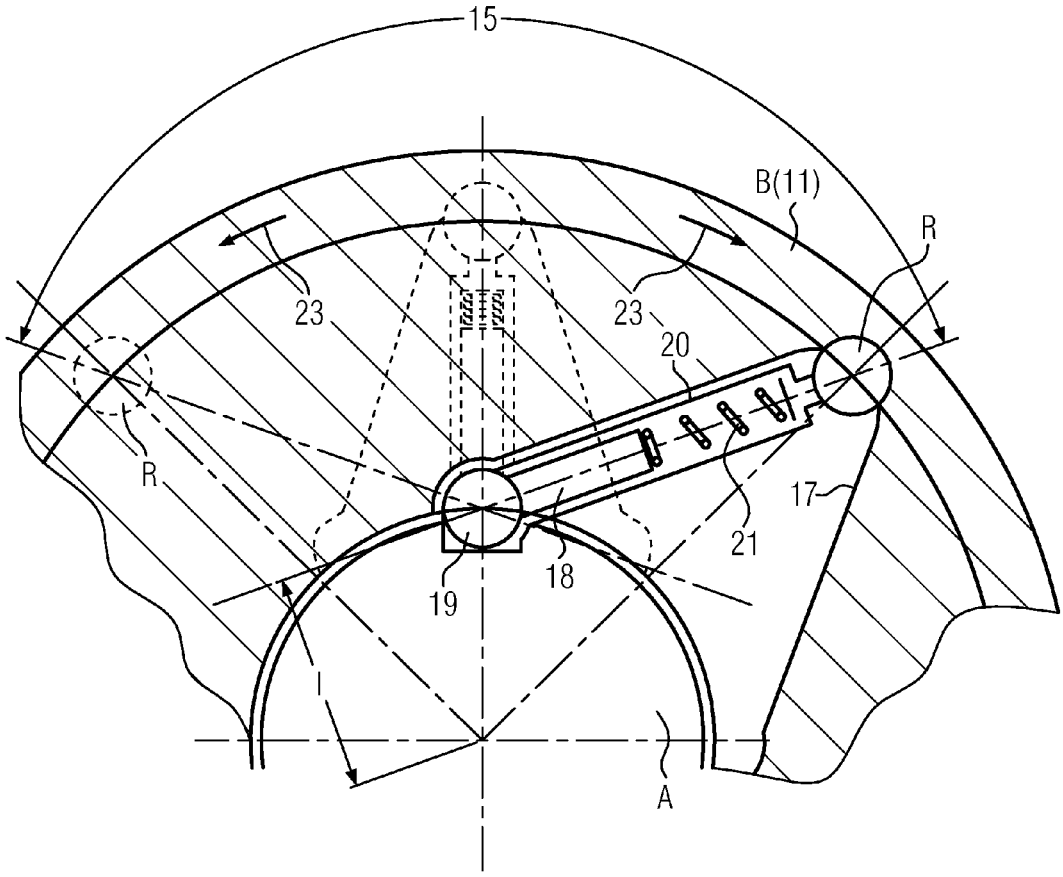
FIG. 5 shows a radial sectional view of a further embodiment of a tamper.

The embodiment according to FIG. 5 provides a different type of locking and/or coupling device V for the tamper T. Here, the eccentric bushing B includes, e.g., in its end flange 11, an outwardly tapering V-shaped abutment recess 17 for a spring support 18, which is spring-loaded in the direction of extension and which pivotably rests via a pivot piston 19 on the circumference of the eccentric section A. A pot piston 20 carrying the detent element R is telescopically displaceable on the pivot piston 19, said pot piston 20 including a spring 21, which is accommodated therein in a preloaded condition and which presses the detent element R into the abutment recess 17 under a preload. In this way, a dead center passing spring mechanism is created, which has its dead center 22 in the middle between, in this case, two defined relative rotational positions of the eccentric bushing B.

It will be expedient to use the locking and/or coupling device V according to FIG. 5 in combination with the driver M explained on the basis of FIGS. 3 and 4 and the end stops 16 so as to additionally lock the adjusted relative rotational position of the eccentric bushing B.

In the case of a changeover through a reversal of the direction of rotation of the drive shaft W, the moment of inertia of the eccentric bushing B is, possibly supported by the higher rotational resistance in the eye of the connecting rod 2, used for first compressing the spring support 18 until a movement beyond the dead center area 22 has taken place and the eccentric bushing B moves further towards the other relative rotational position. During this movement, the preload in the spring support 18 generates from the dead center 22 onwards a supporting torque in the direction of arrow 23 towards the new relative rotational position. This torque in the direction of arrow 23 also creates the locking force at the respective relative rotational position.

Instead of the spring support 18, a flexible spring may be used, which produces an effect similar to that of the spring support 18 between the eccentric section A and the eccentric bushing B.

Figure 6:
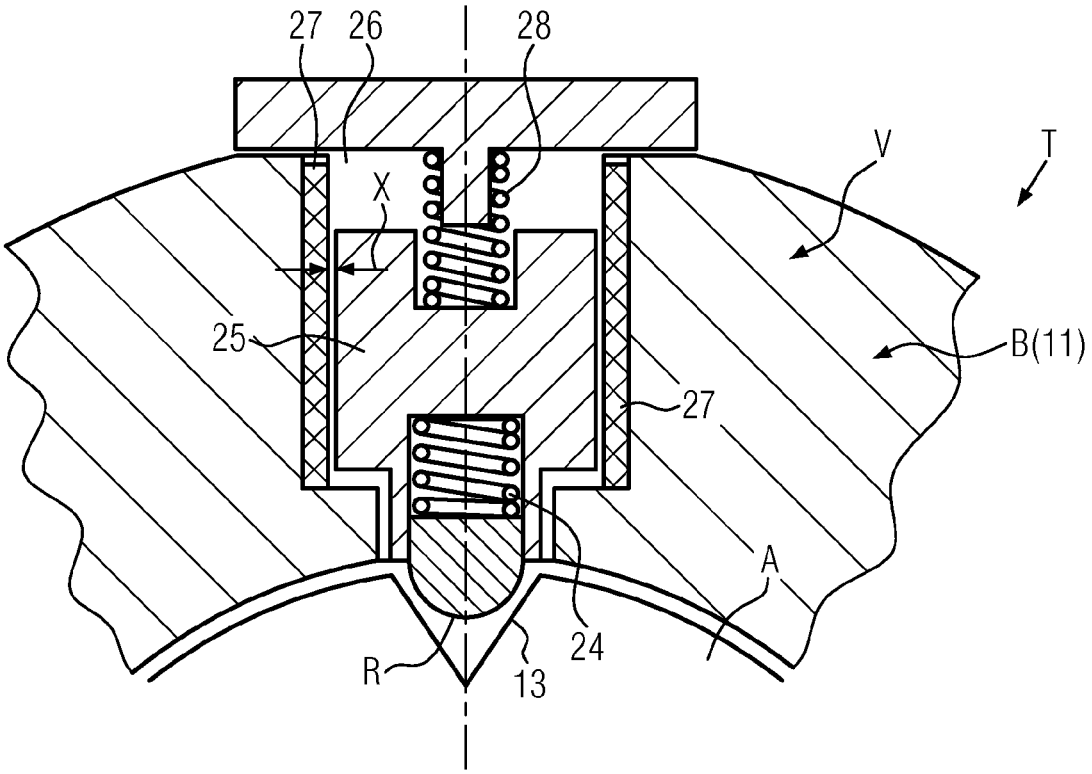
FIG. 6 shows a radial section through a further embodiment of a tamper.

FIG. 6 illustrates an embodiment of the locking and/or coupling device V of the tamper T making use of centrifugal forces. In this embodiment a characteristic of the tamper T is taken into account, viz. that the necessary locking force at the adjusted relative rotational position decreases as the angular speed of the eccentric bushing B increases. If the necessary locking force (which suffices for preventing an inadvertent displacement of the eccentric bushing B) exceeds the existing moment of inertia of the eccentric bushing B, the embodiment according to FIG. 6 makes use of the possibility of utilizing, in addition to the angular acceleration, also the angular speed for a changeover.

In FIG. 6 the detent element R provided for cooperating with the detent recess 13 in the eccentric section A is guided, in an approximately radially movable manner, in a centrifugal mass body 25 and supported therein by a first spring 24 acting on the detent element R in the direction of the rotation center. The centrifugal mass body 25 is guided in a radially displaceable manner in a fluid chamber 26 (filled with a liquid or with a gas, such as air), said centrifugal mass body 25 being e.g., configured like a piston and encompassed by a plain bearing 27, and a fluid throttle gap X is defined between the outer circumference of the centrifugal mass body 25 and the plain bearing 27. The centrifugal mass body 25 rests via a second preloaded spring 28 on a closure of the fluid chamber 26. The locking force produced by the locking and/or coupling device V depends on the angular speed of the eccentric bushing B such that it will only be reduced when the spring 28 is compressed to a certain extent in response to the extension movement of the centrifugal mass body 25 caused by centrifugal forces. This will be the case from an angular speed (a limit speed) onwards, at which the centrifugal force of the centrifugal mass body 25 plus the force of the first spring 24 exceed the force of the second spring 28.

If the tamper T is operated below the limit speed, a locking force will remain effective, which cannot be overcome by the moment of inertia of the eccentric bushing B when a reversal of the direction of rotation takes place. This means that a changeover may perhaps not be possible in this condition. If, however, the tamper T is operated above the limit speed, the locking force will be so low or no longer exist at all, so that, when a reversal of the direction of rotation of the drive shaft W takes place, the moment of inertia of the eccentric bushing B will suffice for causing the detent element R to exit the detent recess 13 and execute the changeover. Even a time window may here be taken into account, after the expiration of which a changeover is possible. This time window is defined by the period of time for which the centrifugal mass body 25 is displaced far enough outwards, i.e., after the tamper T has long enough been operated above the limit speed for the fluid volume above the centrifugal mass body to be discharged e.g., downwards through the fluid throttle gap X. Only then, the locking force has decreased to such an extent that the moment of inertia of the eccentric bushing will overcome the locking force when the reversal of the direction of rotation takes place. The fluid throttle gap X enforces a damped displacement of the centrifugal mass body 25 and determines the magnitude of the duration of the time window.

One advantage of the embodiment according to FIG. 6 is to be seen in that a very high locking force is effective at low angular speeds. Since the centrifugal mass body 25 is even able to lift off the detent element R, the locking and/or coupling device V can act not only as a detent device (with a force- and a form-fit connection), but even an exclusively form-fit engagement situation of the detent element R is imaginable.

Figure 7:
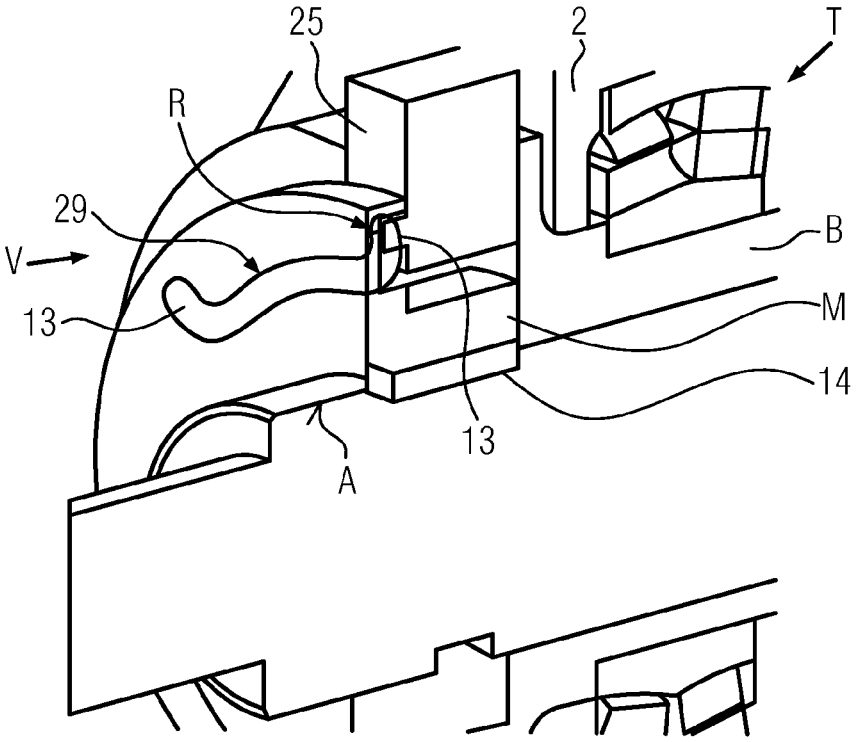
FIG. 7 shows a perspective fragmentary sectional view of a further embodiment of a tamper.
Figure 8:
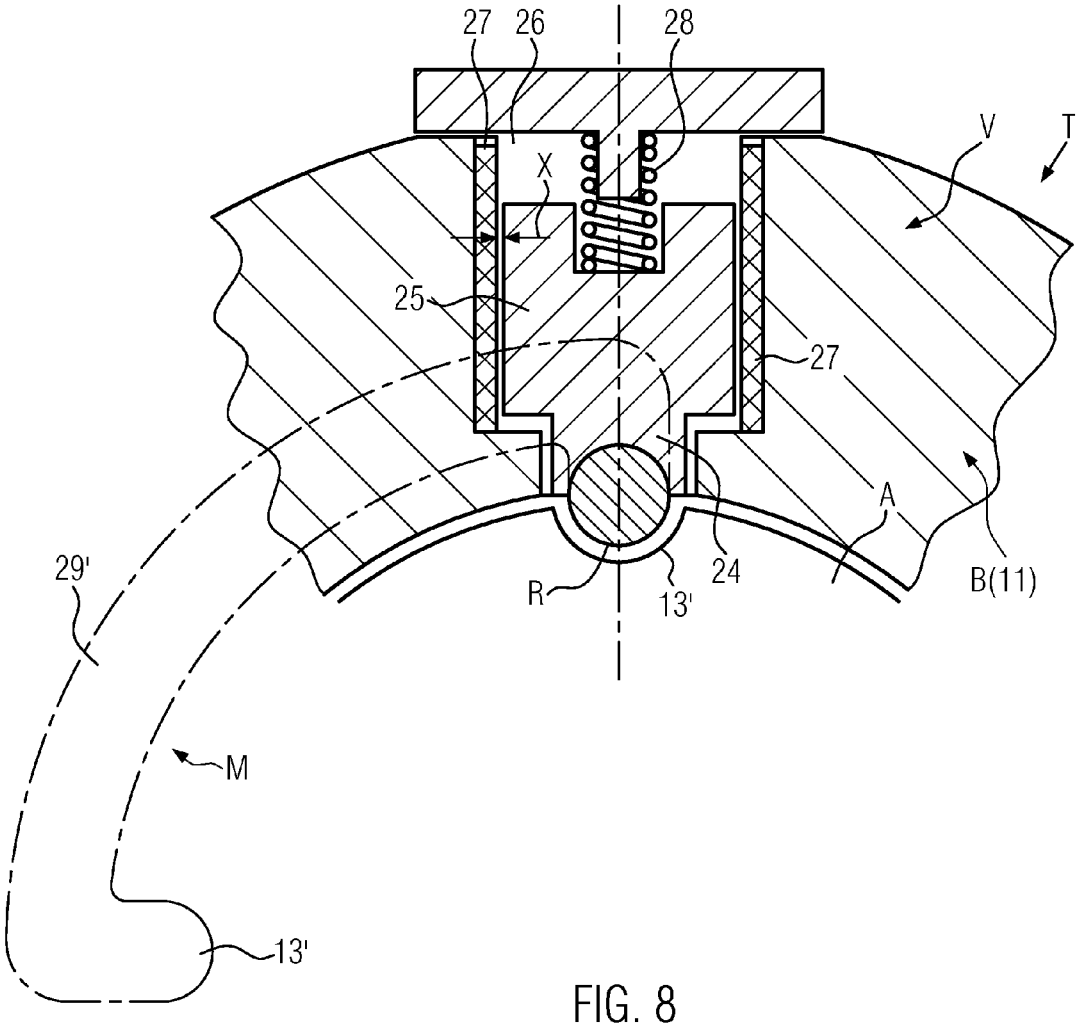
FIG. 8 shows a radial section through a part of a further embodiment of a tamper, similar to that according to FIG. 6.

FIGS. 7 and 8 show embodiments in the case of which a centrifugal mass body 25 directly cooperates with a curved track 29' in the driver M on the eccentric section A.

The detent element R is arranged directly on the centrifugal mass body 25 in FIG. 7 and engages the curved track 29, which is here configured such that it comprises an e.g., arcuate changeover section and, at the two ends of the latter, respective detent recesses 13, which extend approximately radially outwards and which may define so to speak the end stops 16 according to FIGS. 3 and 4, said detent recesses 13 being also effective for locking V in a direction opposite to the direction of rotation. The centrifugal mass body 25 is acted upon towards the rotation center by a spring which is not shown. A changeover is initiated by a reversal of the direction of rotation of the drive shaft W. The detent element R moves within the curved track 29 and is then introduced in a detent recess 13 when the eccentric bushing B has reached the relative rotational position and when also the angular speed prevailing is such that the centrifugal mass body 25 is displaced away from the rotation center. As long as this angular speed has not been reached, a changeover cannot take place. The centrifugal mass body 25 is here acted upon by a spring in the release direction of the locking device V.

In the embodiment according to FIG. 8, the curved track 29' in the driver M on the eccentric section A is configured inversely to the curved track 29 in FIG. 7. The detent recesses 13' extend approximately radially to the rotation center inwards. The detent element R may be fixedly attached to the centrifugal mass body 25, which is supported in the fluid chamber 26 via the preloaded spring 28 and which can be displaced in the plain bearing 27 making use of the fluid throttle gap, if necessary. The centrifugal mass body 25 is thus preloaded in the locking direction of the locking device V. A changeover is here only possible when the eccentric bushing B rotates above a predetermined limit speed at which the centrifugal mass body 25 has been displaced in the release direction of the locking and/or coupling device V to a sufficient extent, e.g., within the above-mentioned time window and through the reversal of the direction of rotation of the drive shaft W.

Figure 9:
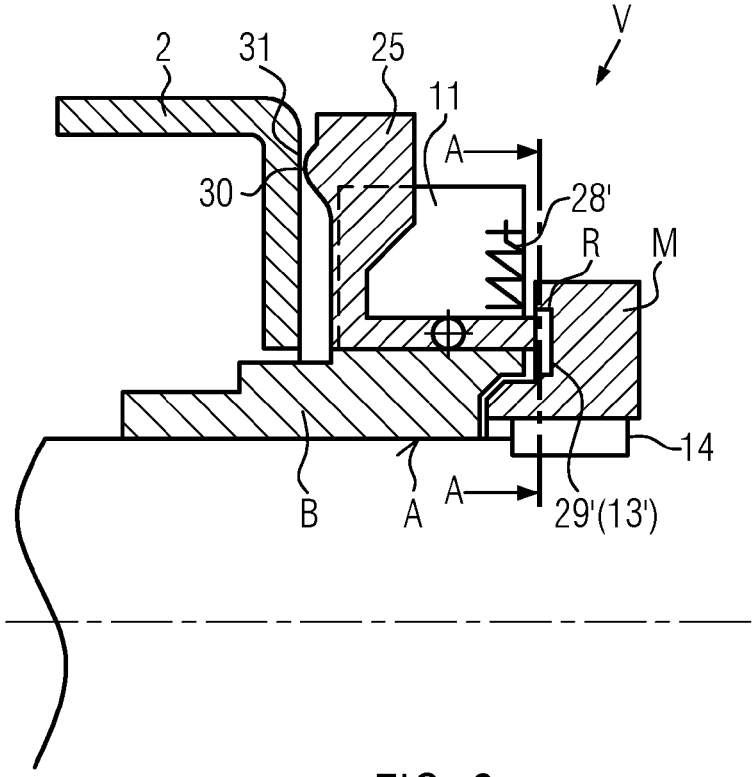
FIGS. 9 and 10 show an axial section and a radial section through a part of a further embodiment of a tamper.
Figure 10:
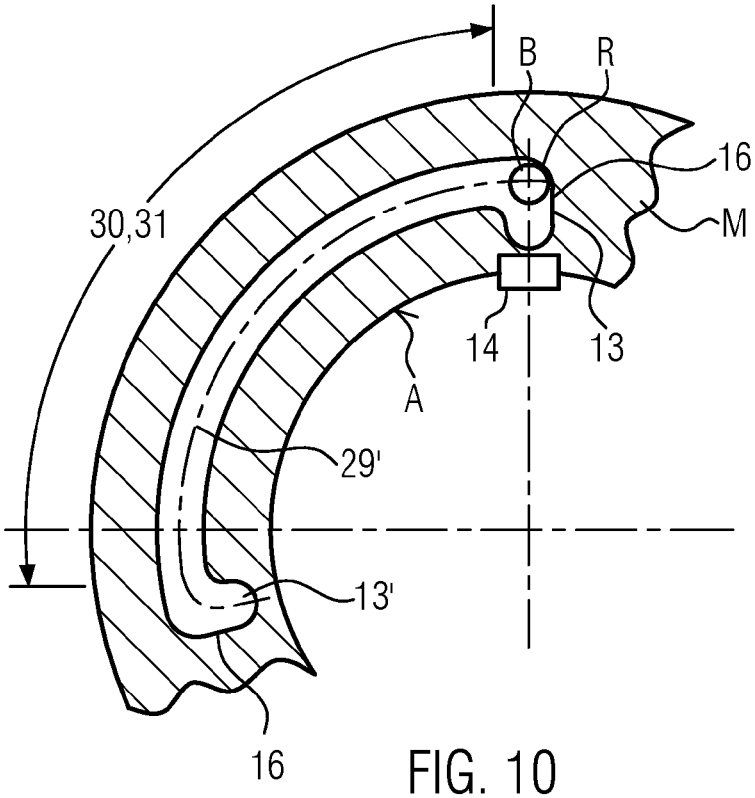

An embodiment similar to that disclosed in FIG. 8 is shown in FIGS. 9 and 10. Here, a combination of the detent element R and a centrifugal mass body 25 and a friction surface 30 and a counter friction surface 31, e.g., on the connecting rod 2, is outlined. The cooperation between the friction element or the friction surface 30 and the counter friction surface 31 supports the changeover. This may be of advantage for embodiments of tampers T whose eccentric bushing B has a very small inertia mass (small moment of inertia when a reversal of the direction of rotation of the drive shaft W takes place) or in tamper sections which only allow minor angular acceleration. The additionally produced friction moment is, however, only effective outside of the relative rotational positions of the adjusted eccentric bushing. The magnitude of the respective effective friction moment can be adjusted e.g., by means of a tension spring 28' shown in FIG. 9. Locking at the respective relative rotational position is only possible in the case of an adequate angular speed. Depending on the respective orientation of the detent recesses 13' of the curved track 29', i.e., inwards or outwards, according to FIGS. 7 and 8, this adequate angular speed must be an adequately low or an adequately high angular speed. The centrifugal mass body 25 is here acted upon e.g., in the direction of the rotation center by a spring that is not shown. The curved track 29' is formed in the driver M that is coupled to the eccentric section A via the key 14. The detent element R is a projection on the centrifugal mass body 25, which takes part in the rotary movement of the eccentric bushing B, but is radially movable therein.

In the case of the above described embodiments according to FIGS. 3 to 10, the eccentric bushing B may have a low frictional resistance on the eccentric section A of the drive shaft W, which, without the influence exerted by the locking and/or coupling device V, would easily lead to inadvertent rotational displacements of the eccentric bushing B.

Figure 11:
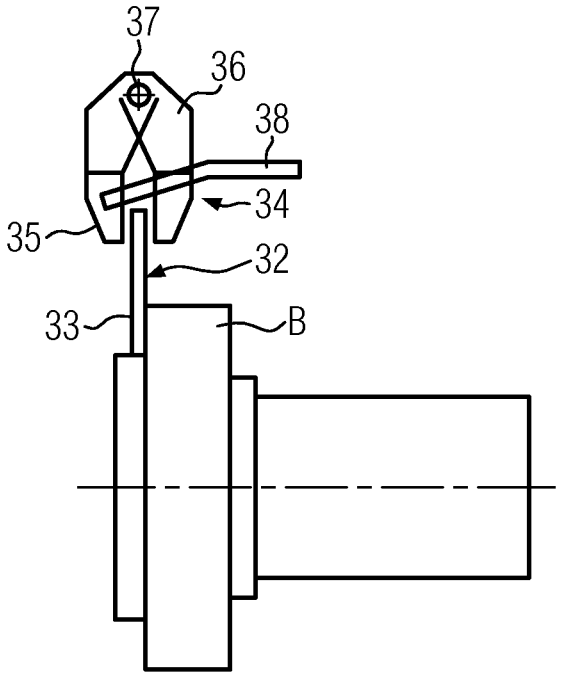
FIG. 11 shows a further embodiment of a tamper in a schematic representation.
Figure 12:
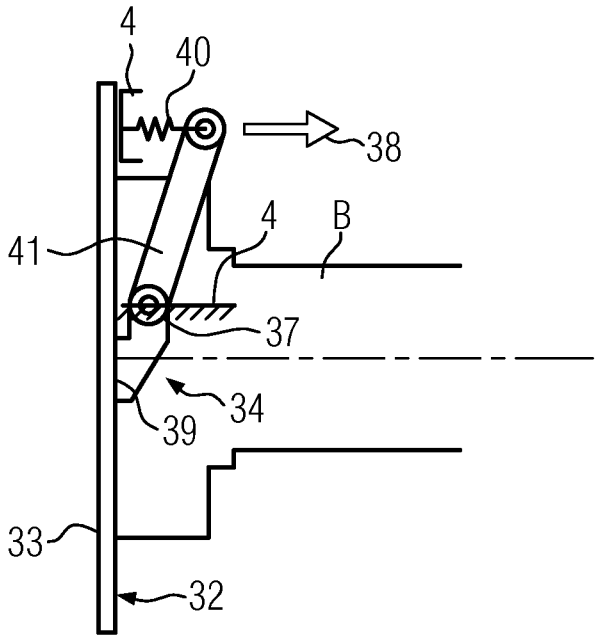
FIG. 12 shows a further embodiment of a detail of a temper.

According to the embodiments shown in FIGS. 11 and 12, the locking and/or coupling device V is configured as a friction-type coupling between the eccentric bushing B and the eccentric section A, i.e., a high friction value is effective between these two components, so that the rotational resistance between them is so high that critical operating situations cannot result in an inadvertent rotational displacement of the eccentric bushing B relative to the eccentric section A. Since the moment of inertia of the eccentric bushing may, however, not be able to overcome the friction-type coupling when a reversal of the direction of rotation takes place, the eccentric bushing B is decelerated in a remotely controlled manner as soon as a changeover takes place in the embodiments according to FIGS. 11 and 12, e.g., also in this case by a reversal of the direction of rotation.

According to FIG. 11, the eccentric bushing B is fixedly connected to a brake body 32, e.g., a brake disk 33, having associated therewith a friction element 34, e.g., a brake caliper 35. The brake caliper 35 is adjusted via a mechanism 36 and a remote control unit 38 between the depicted release position and braking positions on the brake body 32, the friction element being stationarily supported relative to the eccentric bushing B at 37, e.g., in the screed frame 4 according to FIGS. 1 and 2.

In the embodiment according to FIG. 12, the brake body 32 that is fixedly connected to the eccentric bushing B is e.g., a brake disk 33, the locking and/or coupling device V being configured as a friction-type coupling between the eccentric bushing B and the eccentric section A with an adequate permanently high rotational resistance. The brake body 32 is acted upon by a friction element 34, here in the form of a brake lever 41 with a braking area 39, said brake lever 41 being stationarily supported at 37, e.g., on the screed frame 4, and held by a tension spring 40 at a release position which is not shown. The brake lever 41 is acted upon by the remote control unit 38, e.g., a Bowden cable, with which the braking area 39 can be brought into contact with the brake body 32 against the force of the spring 40, so as to decelerate the eccentric bushing B during a changeover or for the purpose of a changeover, until the high rotational resistance in the friction-type coupling has been overcome.

Since the high rotational resistance in the friction-type coupling between the eccentric bushing B and the eccentric section A will always suffice for preventing inadvertent displacements of the eccentric bushing, an arbitrary number of relative rotational positions of the eccentric bushing B can be adjusted by means of the locking and/or coupling device V, or the stroke length of the tamper bar can be adjusted infinitely, e.g., in that, during a reversal of the direction of rotation, the drive shaft W is rotated very slowly, in the decelerated condition of the brake body 32, until a desired relative rotational position has been reached. A reversal of the direction of rotation is here not absolutely necessary for effecting a changeover. A driver M and end stops 16 or the curved track 29, 29' may be provided, but they are not indispensable.

The friction element 34 shown in FIG. 11 can be remotely controlled by hydraulic, electric or pneumatic means, either on the screed E or in the road finishing machine.

Figure 13:
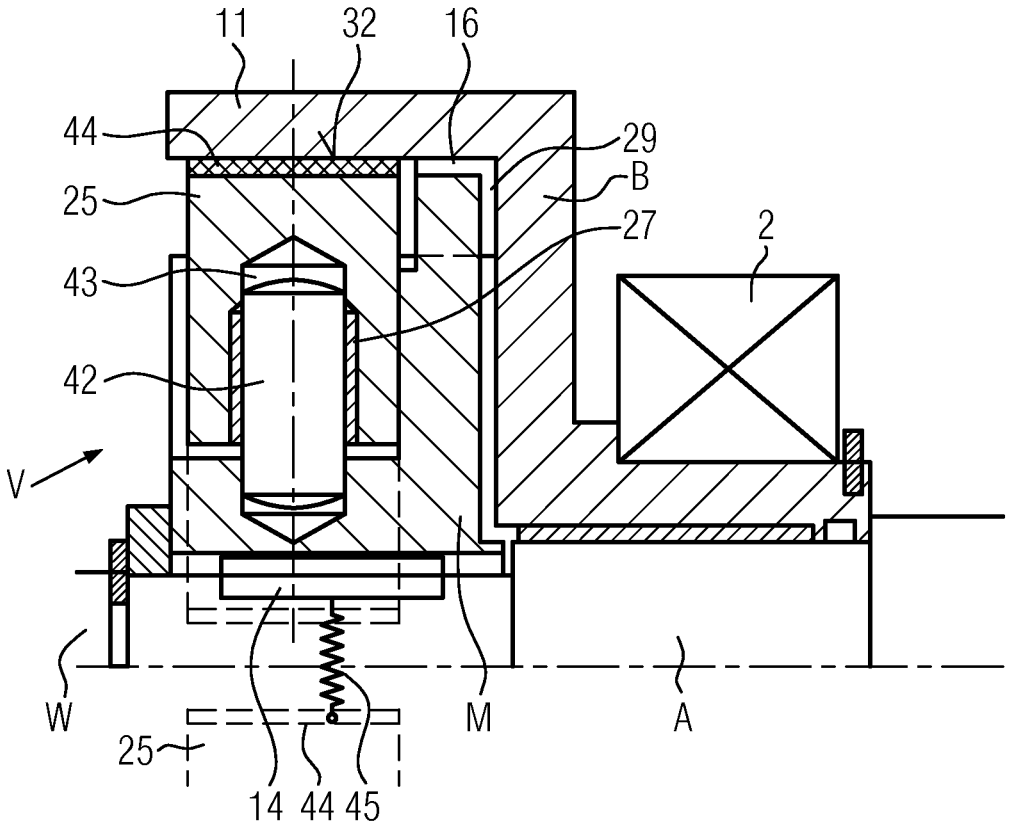
FIG. 13 shows a further embodiment in radial section.

In the embodiment according to FIG. 13, the locking and/or coupling device V between e.g., the axial end flange 11, the eccentric bushing B and the eccentric section A of the drive shaft W is configured such that, when the speed of the drive shaft W exceeds a predetermined limit speed, the eccentric bushing B is coupled to the eccentric section A in a rotation-proof manner by a braking torque, whereas below said limit speed it is adapted to carry out a relative rotation and to be changed over to a different rotational position by a reversal of the direction of rotation, e.g., due to the moment of inertia and/or the rotational resistance in the connecting rod 2. At the new rotational position, the eccentric bushing B and the eccentric section A will not be coupled to one another in a rotation-proof manner until the limit speed is exceeded in the new direction of rotation.

The driver M, which is coupled to the drive shaft W in a rotationally fixed manner by means of the key 14, engages the curved track 29 in the axial end flange 11 of the eccentric bushing B and can be stopped at a respective one of two end stops 16 defining the two different rotational positions. At least one radial pin 42 (preferably two diametrically opposed pins 42) are secured in position in the driver M, said pin 42 extending through a plain bearing bushing 27 in a radial bore 43 in the centrifugal mass body 25 and guiding the centrifugal mass body 25 such that it is radially movable. The centrifugal mass body 25 may (as indicated by the broken line) be an approximately semicircular bowl. A similar, e.g., laterally reversed centrifugal mass body 25 may be guided on the second pin 42 in a diametrically opposed manner. A semi-shell shaped brake pad 44 may loosely rest on or adhere to each centrifugal mass body 25, said brake pad 44 being able to cooperate with an inner friction surface 32 in the axial end flange 11, when the centrifugal mass body 25 has been displaced outwards by centrifugal forces (above the limit speed of the drive shaft W). The resultant braking torque couples the eccentric bushing B to the drive shaft W, so that the driver M stopped at the end stop 16 in one direction of rotation will no longer leave this rotational position in the opposite direction of rotation. The centrifugal mass body 25 is acted upon e.g., by a spring 45 (tension spring) in the direction of the axle. The tension spring 45 determines e.g., the limit speed and is effective e.g., between the two semi-shell shaped brake pads 44.

In the case of all the embodiments the forces used for locking the eccentric bushing B at the relative rotational position may be spring forces, frictional forces, forces of momentum or forces resulting from centrifugal forces, inertia or imbalance or forces generated by hydraulic, pneumatic or magnetic means.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A tamper of a screed, the tamper comprising:

a tamper bar;

a connecting rod secured to the tamper bar;

an eccentric bushing received in the connecting rod and adapted to receive a rotationally drivable drive shaft, the bushing being adapted to be rotationally displaced on an eccentric section of the drive shaft relative to the eccentric section and to be rotationally coupled with the eccentric section at relative rotational positions defining different stroke lengths of the tamper bar, a changeover between the rotational positions being accomplishable by a reversal of direction of rotation of the drive shaft without making use of a tool; and a locking and/or coupling device for locking the eccentric bushing at a respective rotational position against displacement from the respective rotational position, wherein the locking and/or coupling device is adapted to be released and/or engaged automatically or by remote control for effecting a changeover from one rotational position to the next.

2. The tamper according to claim 1 further comprising two end stops and a driver provided between the eccentric bushing and the eccentric section, the end stops and the driver being adapted to be rotated relative to one another about a rotation center of the eccentric section when the changeover takes place, respective positions of contact of the driver on the end stops defining two different relative rotational positions of the eccentric bushing, wherein the locking and/or coupling device is configured to lock the eccentric bushing at least at these two relative rotational positions.

3. The tamper according to claim 1 wherein the locking and/or coupling device is adapted to be released or overcome through forces produced when the changeover takes place, the forces resulting from angular acceleration and/or angular speed and/or moment of inertia and/or a deceleration of the eccentric bushing.

4. The tamper according to claim 1 wherein, when the changeover takes place, an additional changeover torque in the direction of the respective relative rotational position can be produced on the eccentric bushing by the locking and/or coupling device.

5. The tamper according to claim 4 wherein the locking and/or coupling device comprises a dead center passing spring mechanism that produces the additional changeover torque.

6. The tamper according to claim 1 wherein a locking force of the locking and/or coupling device can be produced through force of a spring and/or through rotational friction and/or magnetically and/or hydraulically and/or pneumatically and/or in a centrifugal force dependent manner.

7. The tamper according to claim 4 wherein the locking and/or coupling device comprises a pivotable spring support arranged on the eccentric section, wherein, when the changeover takes place, the spring support is adapted to be reduced in length against preload from spring support positions defining the relative rotational positions up to a dead center and to be extended under the preload when the dead center has been exceeded.

8. The tamper according to claim 1 wherein the locking and/or coupling device is configured as a detent device which is adapted to be acted upon by a force and which comprises a detent element supported on the eccentric section or the eccentric bushing and detent recesses supported on the eccentric bushing or the eccentric section.

9. The tamper according to claim 8 wherein the detent element comprises a radial, spring-loaded detent element supported in the eccentric bushing, and the detent recesses are provided on the eccentric section, the detent recesses being positioned such that they correspond to the relative rotational positions.

10. The tamper according to claim 9 wherein a first spring, which acts on the detent element, is supported in the eccentric bushing on a centrifugal mass body which is radially movable in a fluid chamber and which is supported in the eccentric bushing via a second spring, wherein a fluid throttle gap is provided between the centrifugal mass body and a motion guide for the centrifugal mass body in the fluid chamber, and wherein the detent element and the detent recesses cooperate in a form fit manner.

11. The tamper according to claim 9 wherein the detent element is attached to a centrifugal mass body acted upon by a spring in a release direction of the locking and/or coupling device towards a rotation center, and the detent element is engageable with a curved track, which is fixedly provided on the eccentric section and which comprises a changeover section and at both ends thereof, at end stops, approximately radial detent recesses for the detent element, the detent recesses being oriented in a locking direction.

12. The tamper according to claim 9 wherein the detent element is attached to a centrifugal mass body acted upon by a spring in a locking direction of the locking and/or coupling device away from a rotation center and engages a curved track, which is fixedly provided on the eccentric section and which comprises a changeover section and at both ends of the latter, at end stops, approximately radial detent recesses which are oriented towards the rotation center.

13. The tamper according to claim 8 wherein the detent recesses include two detent recesses that define two relative rotational positions of the eccentric bushing, the eccentric bushing and the connecting rod have provided thereon a friction element and a friction surface for the friction element, and the friction surface extends only between the two detent recesses without including the two detent recesses.

14. The tamper according to claim 8 wherein the detent recesses include two detent recesses that define two relative rotational positions of the eccentric bushing, and the detent element is attached to a centrifugal mass body that is movable with respect to the eccentric bushing against the fore of a spring, and wherein the centrifugal mass body and the connecting rod have provided thereon a friction element and a friction surface for the friction element, and the friction surface extends only between the two detent recesses without including the two detent recesses.

15. The tamper according to claim 3 wherein the locking and/or coupling device comprises a friction-type coupling that is configured to generate a predetermined locking force between the eccentric bushing and the eccentric section, and the eccentric bushing cooperates with a brake body with which at least one friction element that is stationarily supported relative to the eccentric bushing cooperates when the changeover takes place.

16. The tamper according to claim 15 wherein the friction element is adapted to be operated by remote control between a release position and braking positions on the brake body.

17. The tamper according to claim 15 wherein more than two different relative rotational positions of the eccentric bushing are adjustable via the brake body, and the predetermined locking force of the friction-type coupling at each relative rotational position is configured to provide a holding torque for the eccentric bushing that is higher than parasitic torques occurring on the eccentric bushing as a result of operation of the tamper.

18. The tamper according to claim 1 wherein the locking and/or coupling device is configured as a rotational position brake, which is adapted to be engaged by centrifugal forces above a limit speed of the drive shaft and to be disengaged below the limit speed by force of a spring, wherein a respective changeover between relative rotational positions of the eccentric bushing by means of a reversal of direction of rotation can be executed below the limit speed, and wherein the brake comprises a brake pad on a centrifugal mass body and a friction surface for the brake pad on the eccentric bushing.

19. A tamper of a screed, the tamper comprising:

a tamper bar;

a connecting rod secured to the tamper bar;

an eccentric bushing received in the connecting rod and adapted to receive an eccentric section of a rotationally drivable drive shaft, the eccentric bushing being adapted to be rotationally displaced relative to the eccentric section of the drive shaft and to be rotationally coupled with the eccentric section at relative rotational positions defining different stroke lengths of the tamper bar, a changeover between the rotational positions being accomplishable by a reversal of direction of rotation of the drive shaft without making use of a tool; and a locking and/or coupling device for locking the eccentric bushing at each respective rotational position against displacement from the respective rotational position.

20. The tamper according to claim 19 further comprising two end stops and a driver provided between the eccentric bushing and the eccentric section, the end stops and the driver being adapted to be rotated relative to one another when the changeover takes place, respective positions of contact of the driver on the end stops defining two different relative rotational positions of the eccentric bushing, wherein the locking and/or coupling device is configured to lock the eccentric bushing at least at these two relative rotational positions.

* * * * *